US009080272B2

(12) United States Patent
Kim et al.

(10) Patent No.: US 9,080,272 B2
(45) Date of Patent: Jul. 14, 2015

(54) WASHING MACHINE

(75) Inventors: Dong Won Kim, Suwon-si (KR); Byoung Mock Kahm, Suwon-si (KR); Jin Ho Seo, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 829 days.

(21) Appl. No.: 13/337,953

(22) Filed: Dec. 27, 2011

(65) Prior Publication Data

US 2012/0169193 A1 Jul. 5, 2012

(30) Foreign Application Priority Data

Dec. 29, 2010 (KR) ..... 10-2010-0137645

(51) Int. Cl.
*D06F 39/00* (2006.01)

(52) U.S. Cl.
CPC ..... *D06F 39/005* (2013.01); *D06F 2210/00* (2013.01)

(58) Field of Classification Search
CPC ..... D06F 39/005; D06F 2210/00
USPC ..... 68/3 R, 12.27; 200/5 R, 296, 310, 313, 200/317
See application file for complete search history.

(56) References Cited

U.S. PATENT DOCUMENTS

| | | | | |
|---|---|---|---|---|
| 5,464,955 | A * | 11/1995 | Cole | 200/317 |
| 6,750,407 | B2 * | 6/2004 | Song et al. | 200/5 A |
| 7,038,156 | B2 * | 5/2006 | Kim et al. | 200/564 |
| 8,327,671 | B2 * | 12/2012 | Kim | 68/12.27 |
| 8,616,026 | B2 * | 12/2013 | Yoon et al. | 68/12.27 |
| 2004/0148972 | A1 * | 8/2004 | Kang | 68/12.02 |
| 2005/0109592 | A1 * | 5/2005 | Geiger et al. | 200/5 R |
| 2005/0155394 | A1 * | 7/2005 | Brauchle | 68/3 R |
| 2005/0183471 | A1 | 8/2005 | Kang et al. | |
| 2006/0001648 | A1 * | 1/2006 | Kim et al. | 345/156 |
| 2008/0062673 | A1 * | 3/2008 | Hwang et al. | 362/85 |
| 2008/0289940 | A1 * | 11/2008 | Kim et al. | 200/336 |
| 2010/0177494 | A1 | 7/2010 | Kim et al. | |
| 2010/0218565 | A1 * | 9/2010 | Wan et al. | 68/13 R |

FOREIGN PATENT DOCUMENTS

| | | |
|---|---|---|
| CN | 101096813 | 1/2008 |
| CN | 101177887 | 5/2008 |
| EP | 1970479 | 9/2008 |

(Continued)

OTHER PUBLICATIONS

Machine translation of JP 2008-006046 A, no date.*

(Continued)

*Primary Examiner* — Joseph L Perrin
(74) *Attorney, Agent, or Firm* — Staas & Halsey LLP

(57) ABSTRACT

A washing machine including a main body and a control panel mounted to the main body. The control panel includes a control panel frame assembled to the main body, a circuit board housing coupled to a rear side of the control panel frame and having an open rear side, and a circuit board accommodated in the circuit board housing. The circuit board is inserted into the circuit board housing through the open rear side of the circuit board housing such that a front surface thereof, on which light emitting elements to display operational modes of the washing machine are mounted, faces an inner wall surface of a front wall portion of the circuit board housing.

15 Claims, 5 Drawing Sheets

(56) References Cited

FOREIGN PATENT DOCUMENTS

| | | |
|---|---|---|
| JP | 2008-6046 | 1/2008 |
| KR | 10-2006-0031064 | 4/2006 |
| KR | 10-2006-0120943 | 11/2006 |
| KR | 10-2010-0094676 | 8/2010 |

OTHER PUBLICATIONS

Extended European Search Report dated May 10, 2012 issued in corresponding European Patent Application No. 11195729.6.
Chinese Office Action issued Feb. 25, 2015 in corresponding Chinese Patent Application No. 201110460437.X.

* cited by examiner

WASHING MACHINE

CROSS-REFERENCE TO RELATED APPLICATIONS

This application claims the benefit of Korean Patent Application No. 10-2010-0137645, filed on Dec. 29, 2010 in the Korean Intellectual Property Office, the disclosure of which is incorporated herein by reference.

BACKGROUND

1. Field

Embodiments of the present disclosure relate to a washing machine having a control panel.

2. Description of the Related Art

Generally, a washing machine includes a rotating tub in which laundry, such as clothes, etc., are accommodated, and a motor to drive the rotating tub. The washing machine performs a series of operations including washing, rinsing and dehydration using rotation of the rotating tub.

A control panel is attached to a main body of the washing machine. The control panel is provided with a plurality of buttons to select operations of the washing machine and a display window to display operational modes of the washing machine. Also, a circuit board is provided inside the control panel. The circuit boar is provided with Light emitting elements, such as Light Emitting Diodes (LEDs), to display operational modes and switches connected to the buttons to control operations of the washing machine.

In addition, a light guide member to guide light forward from the light emitting elements and a button support member to support the buttons are generally provided between the control panel and the circuit board.

The light emitting elements and switches are mounted on a front surface of the circuit board within a housing having a front opening. An insulating material, such as urethane, etc., is coated on the front surface of the circuit board to prevent transfer of heat when fire occurs on the circuit board.

Since a great number of members are arranged in front of the light emitting elements and switches, scattering of light emitted from the plurality of light emitting elements may occur, resulting in deterioration in display quality of the display window and poor operation ability of the buttons.

Moreover, the control panel consisting of a great number of elements has a complicated assembly process and high production costs.

SUMMARY

It is an aspect of the present disclosure to provide a washing machine having a control panel with enhanced assembly efficiency.

Additional aspects of the disclosure will be set forth in part in the description which follows and, in part, will be apparent from the description, or may be learned by practice of the disclosure.

In accordance with one aspect of the disclosure, a washing machine includes a main body, and a control panel mounted to the main body, wherein the control panel includes a control panel frame assembled to the main body, a circuit board housing coupled to a rear side of the control panel frame and having an open rear side, and a circuit board accommodated in the circuit board housing, and wherein the circuit board is inserted into the circuit board housing through the open rear side of the circuit board housing such that a front surface thereof, on which light emitting elements to display operational modes of the washing machine are mounted, faces an inner wall surface of a front wall portion of the circuit board housing.

The circuit board housing may include the front wall portion provided with a light guide to guide light emitted from the light emitting elements forward, a sidewall portion angled rearward from an edge of the front wall portion, and a circuit board mounting space defined by the front wall portion and the sidewall portion.

The inner wall surface of the front wall portion of the circuit board housing may support the front surface of the circuit board.

The circuit board housing may further include a button mount provided at the front wall portion thereof to support a button by which user button input pressure is applied.

The circuit board housing may be made of fire-retardant plastic.

The washing machine may further include a display panel coupled to the control panel frame to transmit light emitted from the light emitting elements.

The control panel may further include a main control unit to supply power to the circuit board and control operation of the light emitting elements of the circuit board, and the main control unit may be coupled to the circuit board housing to shield at least a part of the open rear side of the circuit board housing.

The main control unit may include a plurality of elements and a control unit housing including an element mounting space in which the elements are mounted, and the control unit housing may include a support portion adjacent to a rear surface of the circuit board.

The support portion of the control unit housing may support the rear surface of the circuit board to secure the circuit board to the circuit board housing when the main control unit is coupled to the circuit board housing.

In accordance with another aspect of the present disclosure, a washing machine includes a main body, a control panel frame mounted to a front upper portion of the main body, a circuit board housing coupled to the control panel frame and provided at a front surface thereof with a light guide to guide light forward, the circuit board housing having an open rear side, and a circuit board inserted into the circuit board housing through the open rear side of the circuit board, the circuit board being provided at a front surface thereof with light emitting elements.

The front surface of the circuit board may have no fire-retardant coating.

The circuit board housing may include a support protrusion protruding rearward therefrom to support the front surface of the circuit board.

The washing machine may further include a main control unit to supply power to the circuit board and control operation of the elements, and the main control unit may be coupled to the rear side of the circuit board housing to cover at least a part of the open rear side of the circuit board housing, the main control unit supporting a rear surface of the circuit board when being coupled to the circuit board housing.

In accordance with another aspect of the present disclosure, a washing machine includes a main body, and a control panel mounted to the main body, wherein the control panel includes a control panel frame assembled to a front upper portion of the main body, a circuit board housing placed at the rear of the control panel frame and coupled to the control panel frame, the circuit board housing having an open rear side, a circuit board accommodated in the circuit board housing, and a main control unit placed at the rear side of the circuit board housing, wherein the circuit board is inserted into the circuit board housing through the open rear side of the circuit board housing such that a front surface thereof, on which light emitting elements are mounted, faces an inner wall surface of a front wall portion of the circuit board housing, and wherein the main control unit supports a rear surface of the circuit board so as to secure the circuit board to the circuit board housing.

In accordance with a further aspect of the present disclosure, a washing machine includes a main body defining an outer appearance of the washing machine, a front plate defining a front upper corner of the main body, and a control panel coupled to the front plate, wherein the front plate includes an opening into which the control panel is mounted, wherein the control panel includes a control panel frame mounted to the front plate and a control unit assembly coupled to the control panel frame, wherein the control unit assembly includes a circuit board housing having an open rear side, a circuit board placed in the circuit board housing, and a main control unit coupled to the circuit board housing to cover at least a part of the open rear side of the circuit board housing, wherein the circuit board is inserted into and accommodated in the circuit board housing through the open rear side of the circuit board housing such that a front surface thereof, on which a plurality of elements is mounted, faces a front wall portion of the circuit board housing, and wherein the front surface and rear surface of the circuit board are supported respectively by the circuit board housing and the main control unit.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
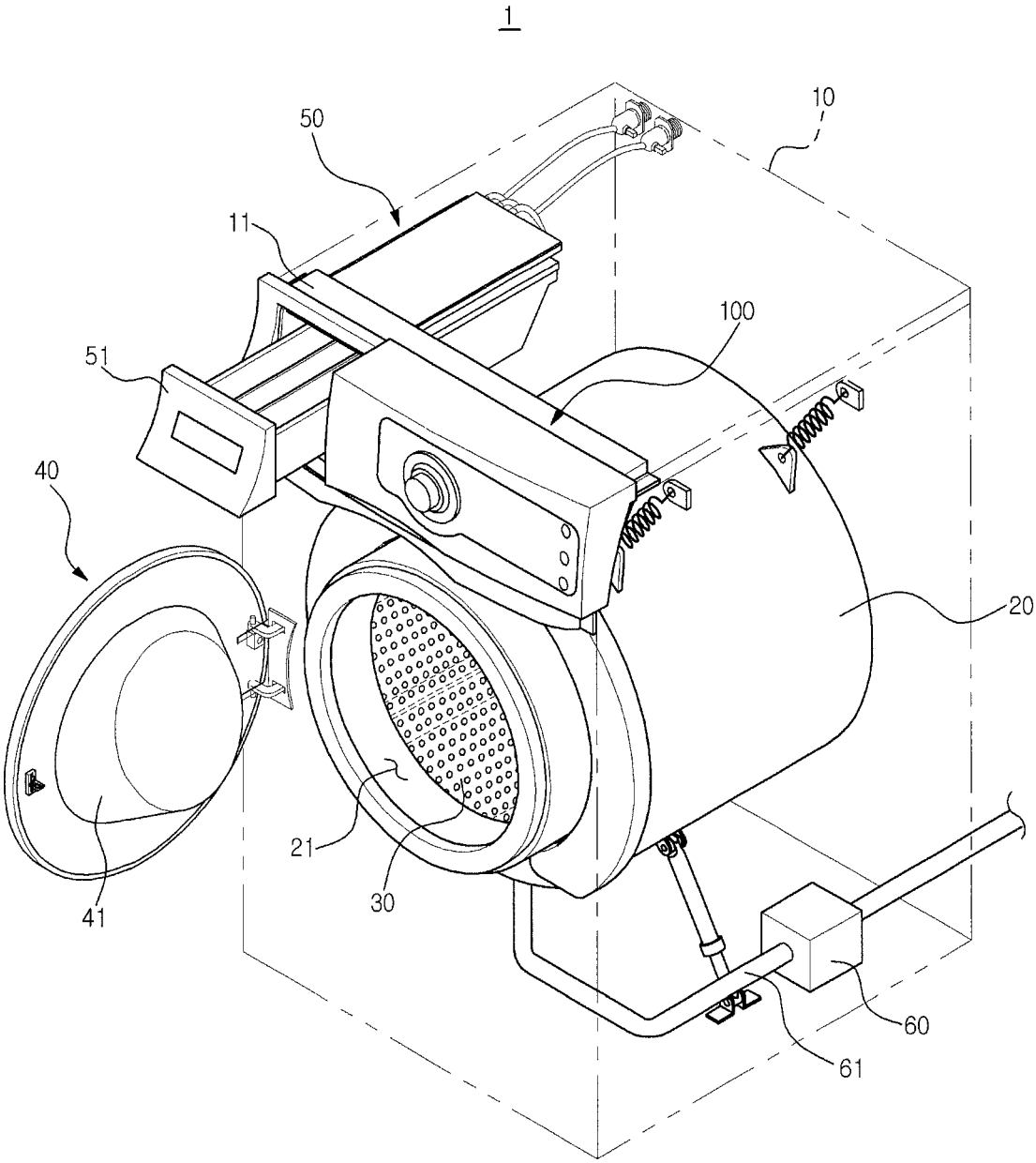
FIG. 1 is a perspective view illustrating a washing machine according to an embodiment of the present disclosure.

Reference will now be made in detail to the exemplary embodiment of the present disclosure, examples of which are illustrated in the accompanying drawings, wherein like reference numerals refer to like elements throughout.

FIG. 1 is a perspective view illustrating a washing machine according to an embodiment of the present disclosure.

As illustrated in FIG. 1, the washing machine 1 includes a main body 10 defining an outer appearance of the washing machine 1, a wash tub 20 placed in the main body 10, and a rotating tub 30 rotatably placed in the wash tub 20. In addition, a drive device (not shown) is installed in the main body 10 to rotate the rotating tub 30 forward or in reverse.

The wash tub 20 is provided at a front side thereof with an opening 21, through which laundry is put into the rotating tub 30. A door 40 is installed to a front surface of the main body 10 to open or close the opening 21. The door 40 is provided with a transparent door glass 41 to allow a user to observe the interior of the rotating tub 30 with the naked eye.

A detergent feeding device 50 is installed above the wash tub 20 to feed detergent-dissolved wash water into the wash tub 20. The detergent feeding device 50 includes a forwardly or rearwardly movable detergent container 51 in which the detergent is accommodated.

A drain pump 60 and a drain pipe 61 are installed below the wash tub 20 to discharge the wash water from the interior of the wash tub 20 to the outside of the main body 10.

A front plate 11 is provided at an upper end of the front surface of the main body 10 to define a corner where the front surface and an upper surface of the main body 10 meet. The front plate 11 may be prefabricated and then, be mounted to the main body 10, or may be integrally formed with the main body 10.

The washing machine 1 performs washing, rinsing, and dehydrating operations. The washing operation may be subdivided in consideration of the kind and contamination degree of laundry, etc., to allow the user to select a suitable washing operation for the laundry. In addition, the washing machine 1 may function to display operational modes thereof to the user.

To this end, the washing machine 1 includes a control panel 100 to enable manipulation of the washing machine 1 by the user and display operational modes of the washing machine 1.

Figure 2:
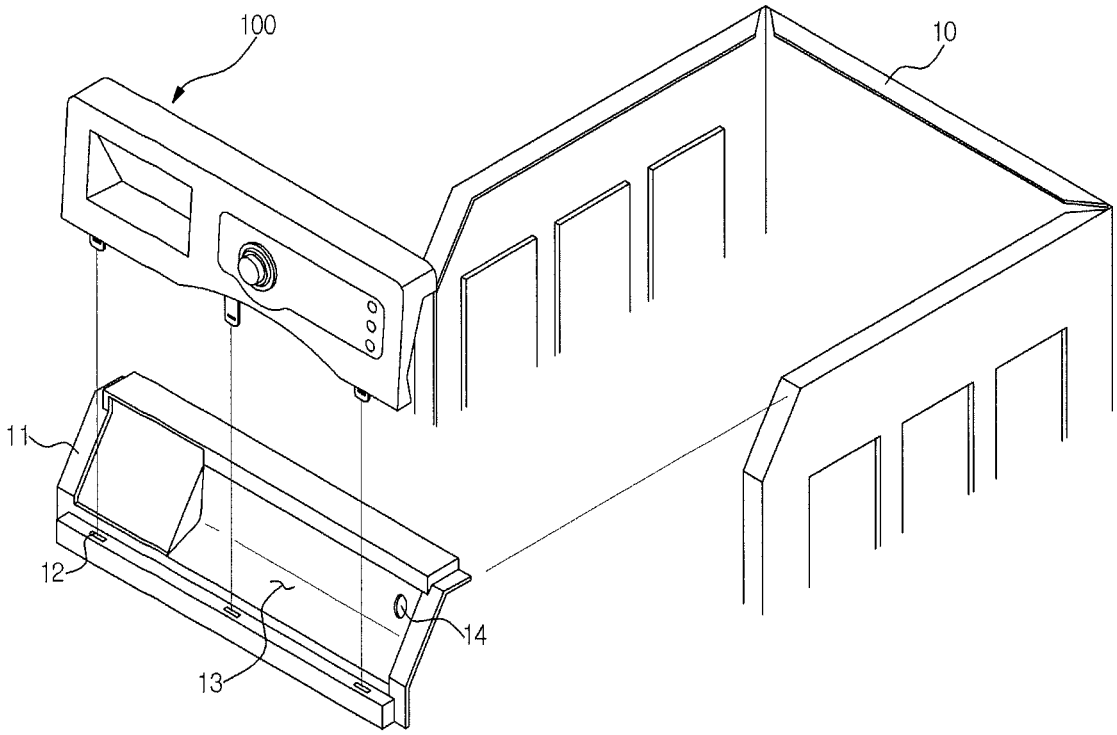
FIG. 2 is a view illustrating a control panel separated from the washing machine according to the embodiment of the present disclosure.

FIG. 2 is a view illustrating the control panel separated from the washing machine according to the embodiment of the present disclosure.

As illustrated in FIG. 2, the control panel 100 is coupled to the front plate 11 from the upper side. The front plate 11 is provided with coupling holes 12, into which coupling hooks 114 of the control panel 100 are inserted. As such, a lower end of the control panel 100 is hooked to the front plate 11. Alternatively, instead of the hook coupling method, various other fitting methods using recesses and bosses, etc. may be used. The front plate 11 is further provided with a cable hole 14, through which, e.g., a power cable to supply power to the control panel 100 and a control cable to control a drive device installed behind the rotating tub 30 to rotate the rotating tub 30 may pass.

The front plate 11 has a control panel mounting recess 13 indented in a front surface thereof, in which a control unit assembly (120, see FIG. 3) which will be described hereinafter is seated.

Figure 3:
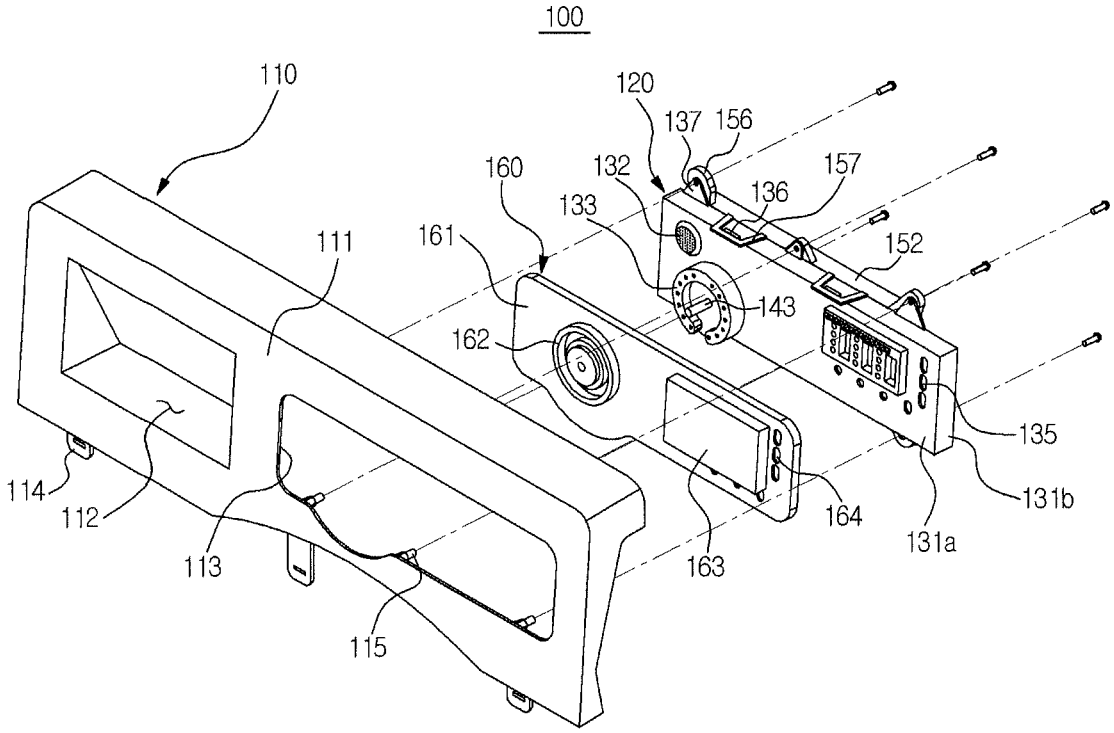
FIG. 3 is an exploded perspective view of the control panel according to the embodiment.
Figure 4:
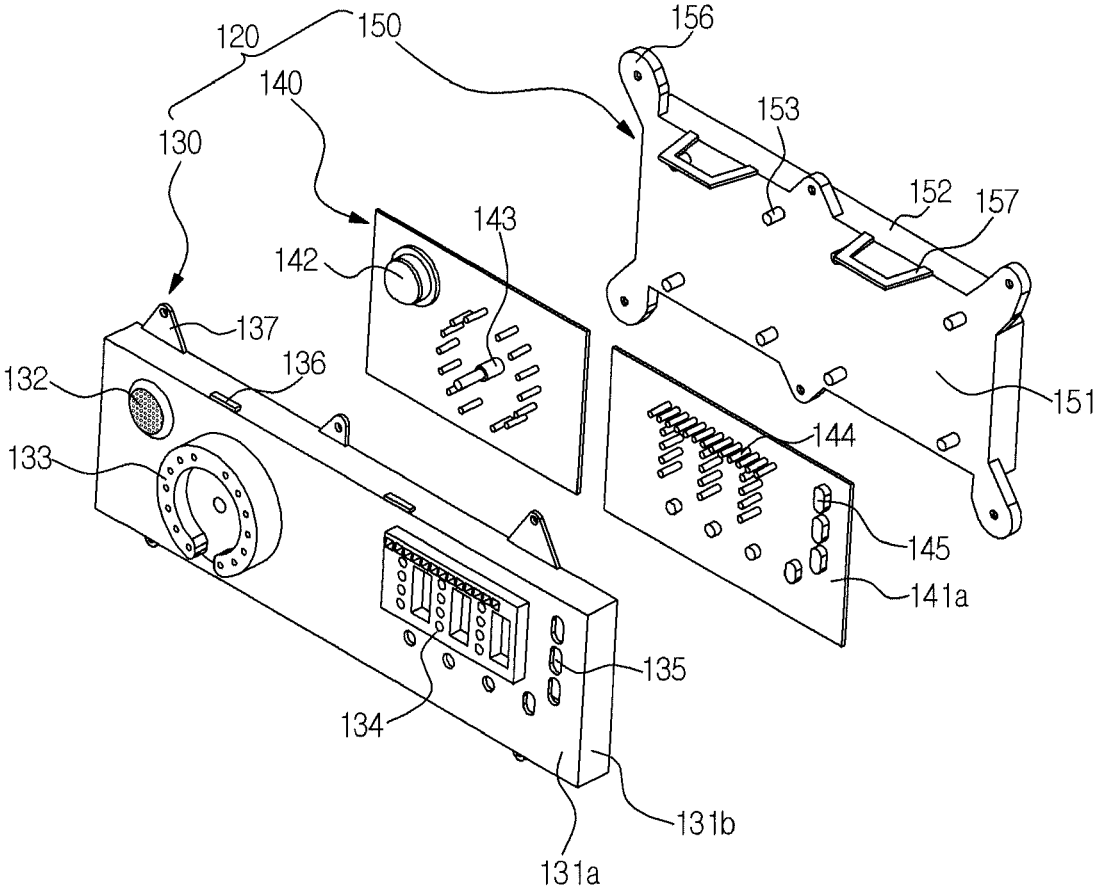
FIGS. 4 and 5 are exploded perspective views illustrating a control unit assembly constituting the control panel according to the embodiment.
Figure 5:
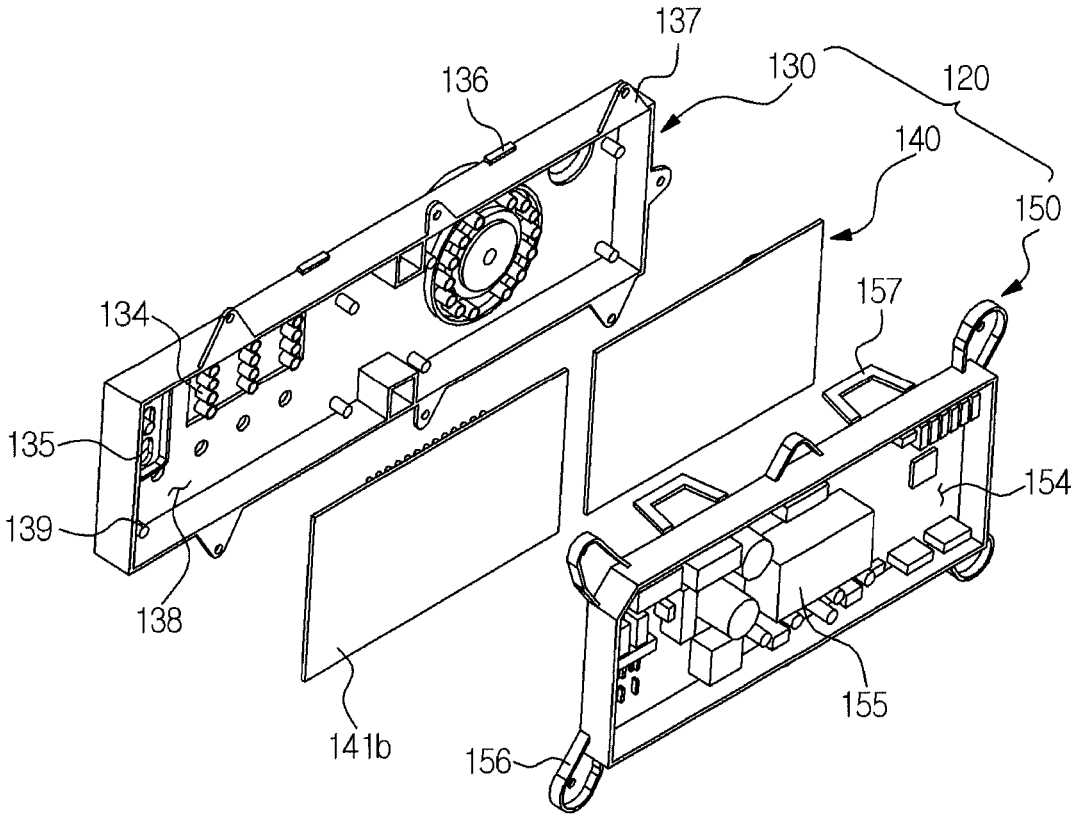

FIG. 3 is an exploded perspective view of the control panel according to the embodiment, and FIGS. 4 and 5 are exploded perspective views illustrating the control unit assembly constituting the control panel according to the embodiment.

As illustrated in FIG. 3, the control panel 100 includes a control panel frame 110, a display panel 160 coupled to the control panel frame 110, and the control unit assembly 120 placed behind the display panel 160.

The control panel frame 110 includes a main frame portion 111 provided with fastening bosses 115 protruding rearward from an inner surface thereof. The fastening bosses 115 are screwed to the control unit assembly 120.

The control panel frame 110 is attached to a front upper position of the washing machine 1 illustrated in FIG. 1. The main frame portion 111 of the control panel frame 110 is perforated with a detergent container entrance/exit opening 112, through which the detergent container 51 is movable forward or rearward, and a display panel coupling opening 113 for coupling of the display panel 160. The display panel coupling opening 113 may have a shape corresponding to that of the display panel 160. The coupling hooks 114 protrude downward from a lower surface of the control panel frame 110.

The display panel 160 has a plate shape. The display panel 160 includes a rotating knob mount 162, on which a rotating knob (not shown) is mounted, a display part 163 to display operational modes of the washing machine 1, and a button mount 164 on which buttons (not shown) to enable manipulation of the washing machine 1 by the user are mounted, all of which are arranged on a front surface 161 of the display panel 160.

The rotating knob mount 162 is centrally perforated with a hole through which a rotating shaft of a rotary switch 143 which will be described hereinafter penetrates. In addition, the rotating knob mount 162 is provided with a guide groove to guide rotation of the rotating knob (not shown).

The display part 163 is printed with, e.g., letters or figures to indicate operational modes of the washing machine 1. As light emitted from the control unit assembly 120 behind the display part 163 penetrates the display part 163, operational modes of the washing machine 1 are displayed. To this end, the display part 163 is made of a light transparent material. The display part 163 may be made of transparent or semi-transparent plastic.

The button mount 164 may be provided with the plurality of buttons (not shown). A button rubber (not shown) having a shape corresponding to that of the button mount 164 may be provided behind the display panel 160. The button rubber (not shown) transmits user button input pressure to the control unit assembly 120 and allows the buttons (not shown) to be returned to original positions thereof when the user button input pressure is released.

The display panel 160 may be coupled to the control panel frame 110 using hooks, screws, etc. The display panel 160 need not be directly coupled to the control frame 110, but may instead come into close contact with the periphery of the display panel coupling opening 113 of the control panel frame 110 because the control unit assembly 120 supports a rear surface of the display panel 160. Also, the rotating knob mount 162 and the button mount 164 need not be provided at the display panel 160, but may instead be provided at the main frame portion 111 of the control panel frame 110.

Although the above description illustrates the display panel 160 as being prefabricated and then, being coupled to the control panel frame 110, the display panel 160 may be integrally formed with the control panel frame 110 so as to constitute a part of the control panel frame 110.

As illustrated in FIGS. 4 and 5, the control unit assembly 120 includes a circuit board 140, a circuit board housing 130 to which the circuit board 140 is coupled, and a main control unit 150 placed behind the circuit board 140.

In the embodiment, only one circuit board may be provided, or a plurality of circuit boards may be provided. If the plurality of circuit boards 140 is provided, the circuit boards 140 may be connected to one another via a cable (not shown).

The circuit board 140 is provided at a front surface 141*a* thereof with a speaker 142 to output sound depending on operational modes, the rotary switch 143 coupled to the rotating knob (not shown), light emitting elements 144 for display of operational modes, and switches 145 to which the user button input pressure is applied. That is, the front surface 141*a* of the circuit board 140 provides an element mounting surface.

The light emitting elements 144 may be turned on or off or may emit different colors of light based on operational modes. The light emitting elements 144 may include Light Emitting Diodes (LEDs).

The circuit board housing 130 includes a front wall portion 131*a* and a sidewall portion 131*b* angled rearward from an edge of the front surface portion 131*a*. The circuit board 140 is accommodated in the circuit board housing 130 such that the front surface 141*a* thereof, on which the elements are mounted, faces an inner wall surface of the front wall portion 131*a* of the circuit board housing 130.

The front wall portion 131*a* of the circuit board housing 130 is provided with a sound passage 132 through which sound of the speaker 142 passes, light guides 133, 134 to guide light emitted from the light emitting elements 144 forward, and button input holes 135 to transmit the user button input pressure to the switches 145. The sound passage 132, light guides 133 134 and button input holes 135 are respectively arranged close to the speaker 142, light emitting elements 144 and switches 145 when the circuit board 140 is coupled to the circuit board housing 130.

The sidewall portion 131*b* of the circuit board housing 130 is provided with at least one fastening flange 137 having a fastening hole and at least one coupling piece 136 for coupling of the main control unit 150. In the embodiment, a plurality of fastening flanges 137 and a plurality of coupling pieces 136 may be provided.

The circuit board housing 130 has an open rear side. A rearwardly open space defined by the front wall portion 131*a* and the sidewall portion 131*b* of the circuit board housing 130 defines a circuit board mounting space 138. The circuit board 140 is accommodated in the circuit board mounting space 138 such that the front surface 141*a* thereof, on which the elements are mounted, faces the inner wall surface of the front wall portion 131*a* of the circuit board housing 130. The circuit board 140 may be inserted into the circuit board mounting space 138 of the circuit board housing 130 through the open rear side of the circuit board housing 130. The circuit board 140 accommodated in the circuit board mounting region 130 may be coupled to the circuit board housing 130 using fastening members, such as screws (not shown), hooks (not shown) provided at the inner wall surface of the front wall portion 131*a* of the circuit board housing 130, etc.

The circuit board housing 130 is made of a fire-retardant material. For example, the circuit board housing 130 may be made of fire-retardant plastic. The front surface 141*a* of the circuit board 140, on which the elements are mounted, may be burned by overheating or electric defects. Covering the front surface 141*a* of the circuit board 140 with the fire-retardant circuit board housing 130 may prevent transfer of heat from the circuit board housing 130 even if fire occurs on the front surface 141*a* of the circuit board 140.

The front wall portion 131*a* of the circuit board housing 130 is provided at a rear surface thereof with support protrusions 139. The support protrusions 139 support the front surface 141*a* of the circuit board 140 such that the circuit board 140 is spaced apart from the front wall portion 131*a* of the circuit board housing 130 by a predetermined distance. Even in the case where the circuit board 140 is spaced apart from the front wall portion 131*a* of the circuit board housing 130, to prevent scatting of light emitted from the light emitting elements 144, the light emitting elements 144 of the circuit board 140 may come into close contact with the light guides 133, 134 of the circuit board housing 130.

The main control unit 150 includes a front wall portion 151 and a sidewall portion 152 angled rearward from an edge of the front wall portion 151. The main control unit 150 has an open rear side and provides an element mounting space 154 defined by the front wall portion 151 and the sidewall portion 152. A circuit board (not shown) is accommodated in the element mounting space 154 and a variety of elements 155 is mounted on the circuit board (not shown). The elements 155 include control elements to control various operations of the washing machine 1 and power supply elements to supply power to the variety of elements. The circuit board 140 is connected to the main control unit 150 via a connecting member, such as a cable, etc.

The sidewall portion 131*b* of the main control unit 150 is provided with at least one coupling hook 157 and at least one fastening flange 156. As the coupling hook 157 of the main control unit 150 is coupled to the coupling piece 136 of the circuit board housing 130, the main control unit 150 is coupled to the circuit board housing 130. In this case, the main control unit 150 covers at least a part of the open rear side of the circuit board housing 130. As such, enhanced assembly efficiency may be obtained because the main control unit 150 is coupled to the circuit board housing 130 without using separate fastening members in a state in which the circuit board 140 is accommodated in the circuit board housing 130. The front surface 141*a* and a rear surface 141*b* of the circuit board 140 may be respectively supported by the inner wall surface of the front wall portion 131*a* of the circuit board housing 130 and the front wall portion 151 of the main control unit 150.

When the main control unit 150 is coupled to the circuit board housing 130, the fastening flange 156 of the main control unit 150 comes into contact with the fastening flange 137 of the circuit board housing 130. As a screw sequentially passes the fastening flange 156 of the main control unit 150 and the fastening flange 137 of the circuit board housing 130 to thereby be fastened to the control panel frame 110, the control unit assembly 120 is secured to the control panel frame 110.

The front wall portion 151 of the main control unit 150 may be provided with support protrusions 153. When the main control unit 150 is coupled to the circuit board housing 130, the support protrusions 153 support the rear surface 141*b* of the circuit board 140. Thus, the circuit board 140 may be kept in a fixed position within the circuit board housing 130 as the support protrusions 139 of the circuit board housing 130 support the front surface 141*a* of the circuit board 140 and the support protrusions 153 of the main control unit 150 support the rear surface 141*b* of the circuit board 140.

The main control unit 150 is made of a fire-retardant material, similar to the circuit board housing 130. Thus, as the main control unit 150 covers the rear surface 141*b* of the circuit board 140, it may be possible to prevent transfer of heat from the main control unit 150 even if fire occurs on the circuit board 140.

The main control unit 150 has conventionally been located distantly from the control panel 100. However, the control panel 100 including the circuit board housing 130 according to the embodiment may have a reduced thickness in a front-and-rear direction and thus, the main control unit 150 may be located close to the control panel 100.

As is apparent from the above description, one or more embodiments include a washing machine in which a circuit board housing placed in front of a circuit board functions to guide light emitted from light emitting elements forward and support buttons, thereby preventing deterioration in display quality due to scattering of light and deterioration in button operation performance. The multifunctional circuit board housing may further enable reduction in the number of constituent elements of the control panel, resulting in a simplified assembly process and reduced production costs.

Further, as a result of providing the circuit board housing and a main control unit, which are made of fire-retardant materials, at front and rear surfaces of the circuit board, it may be possible to prevent transfer of heat even if fire occurs on the circuit board even without coating an element mounting surface of the circuit board with an insulating material such as urethane, etc.

Furthermore, reduction in the number of constituent elements ensures that a thickness of the control panel is thinner, which allows the main control unit, which has conventionally been mounted separately in the washing machine, to be integrally formed with the control panel, resulting in enhanced space utilization within the washing machine.

Although the embodiment of the present disclosure has been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a main body; and a control panel mounted to the main body, wherein the control panel includes a control panel frame assembled to the main body, a circuit board housing coupled to a rear side of the control panel frame and having an open rear side, a circuit board accommodated in the circuit board housing, and a main control unit to supply power to the circuit board, and wherein the circuit board is inserted into the circuit board housing through the open rear side of the circuit board housing such that a front surface thereof, on which light emitting elements to display operational modes of the washing machine are mounted, faces an inner wall surface of a front wall portion of the circuit board housing, and the main control unit is coupled to the circuit board housing to shield at least a part of the open rear side of the circuit board housing.

2. The washing machine according to claim 1, wherein the circuit board housing includes the front wall portion provided with a light guide to guide light emitted from the light emitting elements forward, a sidewall portion angled rearward from an edge of the front wall portion, and a circuit board mounting space defined by the front wall portion and the sidewall portion.

3. The washing machine according to claim 2, wherein the inner wall surface of the front wall portion of the circuit board housing supports the front surface of the circuit board.

4. The washing machine according to claim 2, wherein the circuit board housing further includes a button mount provided at the front wall portion thereof to support a button by which user button input pressure is applied.

5. The washing machine according to claim 1, wherein the circuit board housing is made of fire-retardant plastic.

6. The washing machine according to claim 1, further comprising a display panel coupled to the control panel frame and placed in front of the circuit board housing so as to transmit light emitted from the light emitting elements.

7. The washing machine according to claim 1, wherein the main control unit controls operation of the light emitting elements of the circuit board.

8. The washing machine according to claim 7, wherein the main control unit includes a plurality of elements and a control unit housing including an element mounting space in which the elements are mounted, and wherein the control unit housing includes a front wall portion adjacent to a rear surface of the circuit board.

9. The washing machine according to claim 8, wherein the front wall portion of the control unit housing supports the rear surface of the circuit board to secure the circuit board to the circuit board housing when the main control unit is coupled to the circuit board housing.

10. A washing machine comprising:

a main body;

a control panel frame mounted to a front upper portion of the main body;

a circuit board housing coupled to the control panel frame and provided at a front surface thereof with a light guide to guide light forward, the circuit board housing having an open rear side; and a circuit board inserted into the circuit board housing through the open rear side of the circuit board, the circuit board being provided at a front surface thereof with light emitting elements;

a main control unit to supply power to the circuit board and control operation of the light emitting elements, wherein the main control unit is coupled to the rear side of the circuit board housing to cover at least a part of the open rear side of the circuit board housing, the main control unit supporting a rear surface of the circuit board when being coupled to the circuit board housing.

11. The washing machine according to claim 10, wherein the front surface of the circuit board has no fire-retardant coating.

12. The washing machine according to claim 10, wherein the circuit board housing includes a support protrusion protruding rearward therefrom to support the front surface of the circuit board.

13. A washing machine comprising:

a main body; and a control panel mounted to the main body, wherein the control panel includes a control panel frame assembled to a front upper portion of the main body, a circuit board housing placed at the rear of the control panel frame and coupled to the control panel frame, the circuit board housing having an open rear side, a circuit board accommodated in the circuit board housing, and a main control unit placed at the rear side of the circuit board housing, wherein the circuit board is inserted into the circuit board housing through the open rear side of the circuit board housing such that a front surface thereof, on which light emitting elements are mounted, faces an inner wall surface of a front wall portion of the circuit board housing, and wherein the main control unit supports a rear surface of the circuit board so as to secure the circuit board to the circuit board housing.

14. The washing machine according to claim 13, wherein the main control unit is coupled to the circuit board housing without using separate fastening members in a state in which the circuit board is accommodated in the circuit board housing.

15. A washing machine comprising:

a main body defining an outer appearance of the washing machine;

a front plate defining a front upper corner of the main body; and a control panel coupled to the front plate, wherein the front plate includes an opening into which the control panel is mounted, wherein the control panel includes a control panel frame mounted to the front plate and a control unit assembly coupled to the control panel frame, wherein the control unit assembly includes a circuit board housing having an open rear side, a circuit board placed in the circuit board housing, and a main control unit coupled to the circuit board housing to cover at least a part of the open rear side of the circuit board housing, wherein the circuit board is inserted into and accommodated in the circuit board housing through the open rear side of the circuit board housing such that a front surface thereof, on which a plurality of elements is mounted, faces a front wall portion of the circuit board housing, and wherein the front surface and rear surface of the circuit board are supported respectively by the circuit board housing and the main control unit.

* * * * *